US007130556B2

(12) United States Patent
Kinouchi et al.

(10) Patent No.: US 7,130,556 B2
(45) Date of Patent: Oct. 31, 2006

(54) FIXING UNIT

(75) Inventors: Satoshi Kinouchi, Tokyo (JP); Osamu Takagi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 17 days.

(21) Appl. No.: 11/104,499

(22) Filed: Apr. 13, 2005

(65) Prior Publication Data

US 2005/0175369 A1 Aug. 11, 2005

Related U.S. Application Data

(63) Continuation of application No. 10/445,210, filed on May 27, 2003, now Pat. No. 6,889,018.

(30) Foreign Application Priority Data

May 27, 2002 (JP) ..... 2002-152675

(51) Int. Cl.
*G03G 15/20* (2006.01)

(52) U.S. Cl. ..... 399/69; 399/70; 399/328

(58) Field of Classification Search ..... 399/38, 399/67, 68, 69, 70, 328, 329, 330; 219/216
See application file for complete search history.

(56) References Cited

U.S. PATENT DOCUMENTS

| | | | |
|---|---|---|---|
| 6,026,273 | A | 2/2000 | Kinouchi et al. |
| 6,078,781 | A | 6/2000 | Takagi et al. |
| 6,087,641 | A | 7/2000 | Kinouchi et al. |
| 6,097,926 | A | 8/2000 | Takagi et al. |
| 6,137,985 | A | 10/2000 | Kinouchi et al. |
| 6,154,629 | A | 11/2000 | Kinouchi et al. |
| 6,337,969 | B1 | 1/2002 | Takagi et al. |
| 6,415,128 | B1 | 7/2002 | Takagi et al. |
| 6,438,335 | B1 | 8/2002 | Kinouchi et al. |
| 6,577,839 | B1 | 6/2003 | Samei |
| 6,630,651 | B1 | 10/2003 | Ohishi et al. |
| 6,643,476 | B1 | 11/2003 | Kinouchi et al. |
| 6,643,491 | B1 | 11/2003 | Kinouchi et al. |
| 6,674,929 | B1 | 1/2004 | Feng et al. |
| 6,724,999 | B1 | 4/2004 | Kikuchi et al. |
| 6,725,000 | B1 | 4/2004 | Takagi et al. |
| 6,763,206 | B1 | 7/2004 | Kinouchi et al. |
| 6,861,630 | B1 | 3/2005 | Kinouchi et al. |
| 6,868,249 | B1 | 3/2005 | Kinouchi et al. |
| 6,868,250 | B1 * | 3/2005 | Takagi et al. ..... 399/328 |
| 6,871,041 | B1 | 3/2005 | Takagi et al. |
| 2004/0141038 | A1 | 7/2004 | Takagi et al. |
| 2004/0175211 | A1 | 9/2004 | Sone |
| 2004/0175212 | A1 | 9/2004 | Tsueda et al. |
| 2004/0208665 | A1 * | 10/2004 | Takematsu ..... 399/69 |
| 2004/0265021 | A1 * | 12/2004 | Kinouchi et al. ..... 399/334 |

FOREIGN PATENT DOCUMENTS

JP 8-076620 A 3/1996

(Continued)

*Primary Examiner*—Hoan Tran
(74) *Attorney, Agent, or Firm*—Foley & Lardner LLP

(57) ABSTRACT

A fixing device of the present invention has first and second thermistors which detect the temperatures at predetermined positions in the longitudinally direction of a heating roller, first and second coils which can increase independently the temperatures at the center and the end of the heating roller, a driving circuit which supply power alternately to the coils, first and second switching circuits which supply a predetermined power to each coil, a control unit, and a temperature detection circuit.

14 Claims, 6 Drawing Sheets

FOREIGN PATENT DOCUMENTS

| | | | |
|---|---|---|---|
| JP | 9-258586 | A | 10/1997 |
| JP | 2000-206813 | A | 7/2000 |
| JP | 2001-312178 | A | 11/2001 |

* cited by examiner

FIXING UNIT

CROSS-REFERENCE TO RELATED APPLICATIONS

The present application is a continuation of U.S. application Ser. No. 10/445,210, filed May 27, 2003 now U.S. Pat. No. 6,889,018, which claims priority of Japanese Patent Application No. 2002-152675, filed May 27, 2002, the entire contents of which are incorporated herein by reference.

BACKGROUND OF THE INVENTION

1. Field of the Invention

The present invention relates to a heating unit using induction heating, and more particularly, to a fixing unit which fixes toner as a visualizing agent melt at predetermined temperature usable for an electrophotographic copying machine or printer.

2. Description of the Related Art

A fixing unit incorporated in a copying machine using an electrophotographic process fixes melted toner on a fixing material by heating and pressing. As a method of heating toner usable for the fixing unit, a method using the heat radiated from a filament lamp and a flash heating method using a flash lamp as a heat source are known well.

However, the fixing unit using a filament lamp heats adopts a roller body surrounding a lamp by the light and infrared ray generated by a filament lamp. Therefore, the heat transformation efficiency is 60 to 70%, considering the loss when the light is converted into heat and the efficiency when the air warmed in the roller transmits heat to the roller. Thus, it is known that the warming up takes a long time.

In the above background, the Jpn. Pat. Appln. KOKAI Publication No. 9-258586 and No. 8-76620 proposed a fixing unit using an induction heating unit as a heat source.

The Jpn. Pat. Appln. KOKAI Publication No. 9-258586 disclosed a fixing unit which heats a roller by generating an induced current (eddy current) in the roller by flowing a current in an induction coil made by winding a coil around a core provided along a rotation axis of a metallic roller.

The Jpn. Pat. Appln. KOKAI Publication No. 8-76620 disclosed a fixing unit, which is provided with a conductive film containing a magnetic field generation means, and a pressure roller coming in close contact with the conductive film, and fixes toner to a recording medium fed between the induction film and the pressure roller, by heating the conductive film.

There is a problem peculiar to a fixing unit used in a copying machine, since the size of a fixing paper (the paper pass width) is not even, the temperature at a part of the metallic roller or film becomes uneven.

The Jpn. Pat. Appln. KOKAI Publication No. 2000-206813 disclosed an example of controlling the power supplied to coils, to prevent the uneven temperature in the paper pass width, by providing a plurality of coils to meet the paper pass width, along the axial direction of a fixing roller. The fixing unit disclosed by this publication detects the fixing roller temperature at a plurality of detection points, and controls the power supplied to each coil, based on the temperatures detected at each detection point.

In the coil driving method disclosed by the Publication No. 2000-206813, the power supplied to a plurality of coils is changed at the same time. Thus, a frequency difference occurs in the power flowing in each coil, and an interference noise (whine) occurs. Further, it is necessary to provide a device for each coil to detect the power supplied to each coil.

The Jpn. Pat. Appln. KOKAI Publication No. 2001-312178 disclosed an example to supply power independently to each of multiple coils.

In the driving method disclosed by the Jpn. Pat. Appln. KOKAI Publication No. 2001-312178, there is a problem that a device which detects the power supplied to each coil must be provided independently for each coil.

Namely, in the coil driving method disclosed by the above-mentioned patent publications, it is necessary to control the power of the whole fixing unit while controlling the power at each coil, and it becomes necessary to provide a circuit to control the power at each coil, in addition to the power supply of the unit.

In the example where the coils are simultaneously driven, the power to generate in each coil is changed depending on the temperature difference in the longitudinally direction of the roller. In this case, the frequency of the inverter circuit is changed by the output. This means that two or more coils are driven with different frequencies, causing an interference noise. Particularly, when the frequency difference is larger, the interference noise becomes louder.

Either patent publication describes the method of detecting the temperature difference in the temperature detection means provided at the positions relative to each coil, and distributing the power to each coil based on the detected temperature differences. However, when changing the power distribution, the voltage fluctuation and temperature ripple are different.

Therefore, when simply changing the coil to which power is supplied, a problem may arise in the surrounding illumination, that is, a flicker may occur in a fluorescent lamp. Of course, a larger temperature ripple increases unevenness in the fixing performance.

BRIEF SUMMARY OF THE INVENTION

It is an object of the present invention to provide a fixing unit of the induction heating system which can suppress an interference noise and prevent a flicker or the like in the surrounds.

According to an aspect of the present invention, there is provided a fixing device comprising:

a heat-producing member which is formed cylindrical or belt-like, and made of material to generate an induced current by electromagnetic induction;

a press member which is located to provide a predetermined pressure to the heat-producing member, and provides a predetermined pressure to a medium passing between the heat-producing member;

a first coil member which is supplied with a predetermined power to generate an induced current in the heat-producing member;

a second coil member which is located at a predetermined position with respect to the first coil member and the heat-producing member, and is supplied with a predetermined power to generate an induced current in the heat-producing member;

a first temperature detection mechanism which is provided close to a first position where the heat-producing member is heated by the induced current from the first coil member, and detects the temperature at the first position of the heat-producing member;

a second temperature detection mechanism which is provided close to a second position where the heat-producing member is heated by the induced current from the second coil member, and detects the temperature at the second position of the heat-producing member;

a temperature difference detection mechanism which detects the temperature at the first position of the heat-producing member detected by the first temperature detection mechanism, with the temperature at the second position of the heat-producing member detected by the second temperature detection mechanism; and a driving control mechanism which switches the timing to supply a predetermine power to the first and second coil members, when the temperature difference value outputted from the temperature difference detection mechanism becomes to be a predetermined value.

According to another aspect of the present invention, there is provided a method of controlling a temperature of a fixing device comprising:

recognizing the temperature difference between heating objects depending on the positions of the coil members, based on the temperature information outputted from the temperature detection mechanism; and stopping supply of power to the coil member which generates an induced current at a higher temperature position of the heating object, and supplying power to the coil member which generates the induced current at a lower temperature position.

According to another aspect of the present invention, there is provided a fixing device comprising:

a heat-producing member which is formed cylindrical or belt-like, and made of material to generate an induced current by electromagnetic induction;

a press member which is located to provide a predetermined pressure to the heat-producing member, and provides a predetermined pressure to a medium passing between the heat-producing member;

a first coil member which is supplied with a predetermined power to generate an induced current in the heat-producing member;

a second coil member which is located at a predetermined position with respect to the first coil member and the heat-producing member, and is supplied with a predetermined power to generate an induced current in the heat-producing member;

a first temperature detection mechanism which is provided close to a first position where the heat-producing member is heated by the induced current from the first coil member, and detects the temperature at the first position of the heat-producing member;

a second temperature detection mechanism which is provided close to a second position where the heat-producing member is heated by the induced current from the second coil member, and detects the temperature at the second position of the heat-producing member;

a temperature difference detection mechanism which compares the temperature at the first position of the heat-producing member detected by the first temperature detection mechanism, with the temperature at the second position of the heat-producing member detected by the second temperature detection mechanism, and outputs the temperature difference between the two temperatures;

a power supply mechanism which supplies a predetermined power to the first and second coil members at a predetermined distribution ratio; and a driving control mechanism which detects the temperature difference outputted from the temperature difference detection mechanism at a predetermined timing, and changes the time to supply a predetermined power to the coil members while keeping the distribution ratio determined by the power supply mechanism, according to the detected temperature difference, and the operation states where a medium passes between the heat-producing member and the press member, the heat-producing member generates a heat, and in a standby state where a medium is not fed between the heat-producing member and the press member for a predetermined time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, an example of the induction heating fixing unit according to the present invention will be explained with reference to the accompanying drawings.

Figure 1:
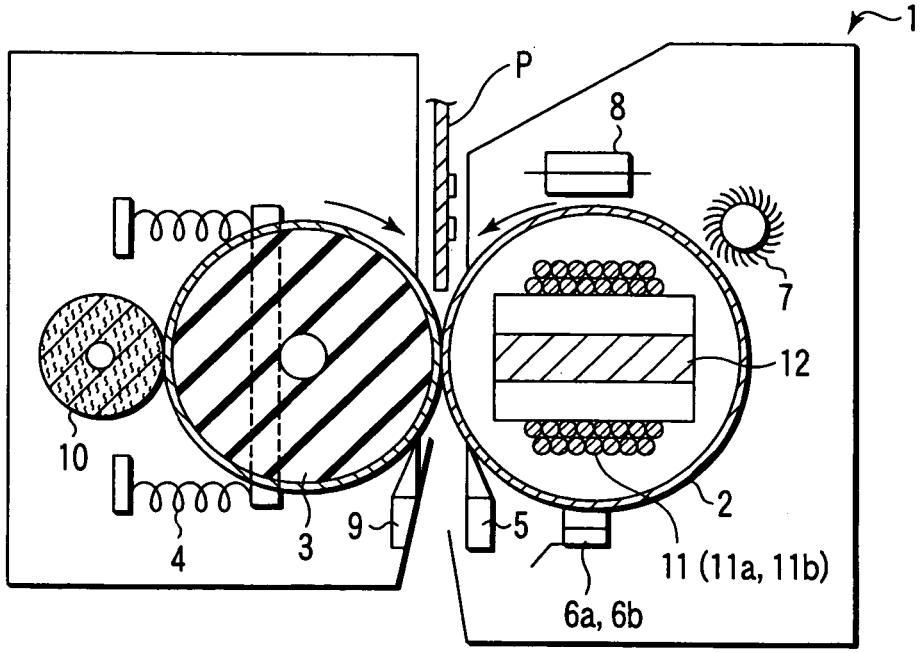
FIG. 1 is a schematic diagram explaining an example of a fixing unit of the induction heating type according to the present invention.
Figure 2:
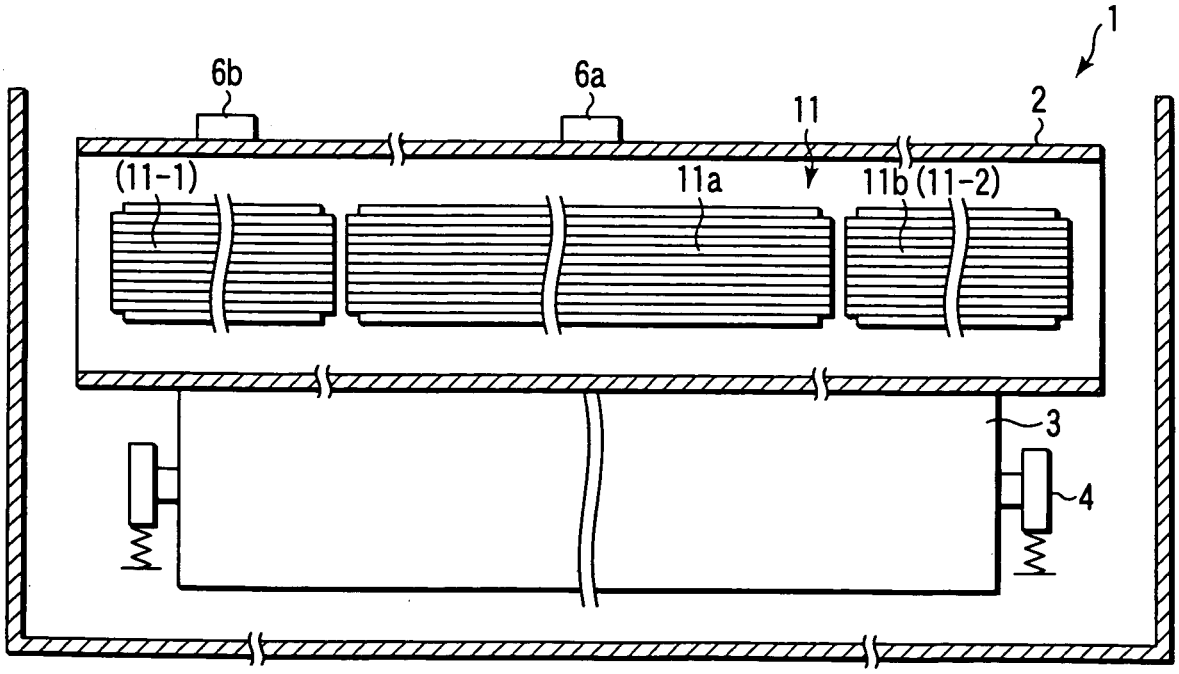
FIG. 2 is schematic plan view of the fixing unit shown in FIG. 1, with the covers removed and viewed from the plan direction.

FIG. 1 is a schematic cross sectional view showing the fixing unit of the invention, cut almost the center in the longitudinally direction. FIG. 2 is a schematic plan view showing the fixing unit of FIG. 1, with the covers not explained in detail removed, and viewed from the plan direction.

A fixing unit 1 includes a heating (fixing) roller 2 with the diameter of about 50 mm, and a press roller 3 with the diameter of about 50 mm.

The fixing roller 2 is a metallic hollow cylinder with the thickness of 1.5 mm. Iron is used in this embodiment, but stainless steel, aluminum or stainless steel-aluminum alloy can be used. The fixing roller 2 is about 340 mm long in this example.

On the surface of the fixing roller 2, a not-shown releasing layer is formed fluoric resin such as ethylene tetrafluoride (Teflon (trade name)), for example, to a predetermined thickness.

It is allowed to replace the fixing roller 2 by a metallic film formed metal has a predetermined thickness on the surface of highly heat-resistant resin film sheet and making it like an endless-belt.

The press roller 3 is made by forming (covering) a silicon rubber with a predetermined thickness or an elastic material such as fluoric rubber around the axis with a predetermined diameter. The press roller 3 is about 320 mm long. The press roller 3 is arranged, so that the axis of itself becomes almost parallel to the axis of the fixing roller 2, and in being pressed to the axis of the fixing roller 2 by a predetermined pressure through a pressing mechanism 4. With this arrangement, a part of the outer circumference of the pressure roller 3 is elastically deformed, and a predetermined nip is provided between the two rollers. When a metallic film is used instead of the fixing roller 2, the nip may be formed in the side of the film.

In the downstream of the nip in the direction of the rotation of the fixing roller 2, a separation claw 5 which separate paper P passing through the nip from the fixing roller 2 is provided at a predetermined position close to the nip.

Figure 3:
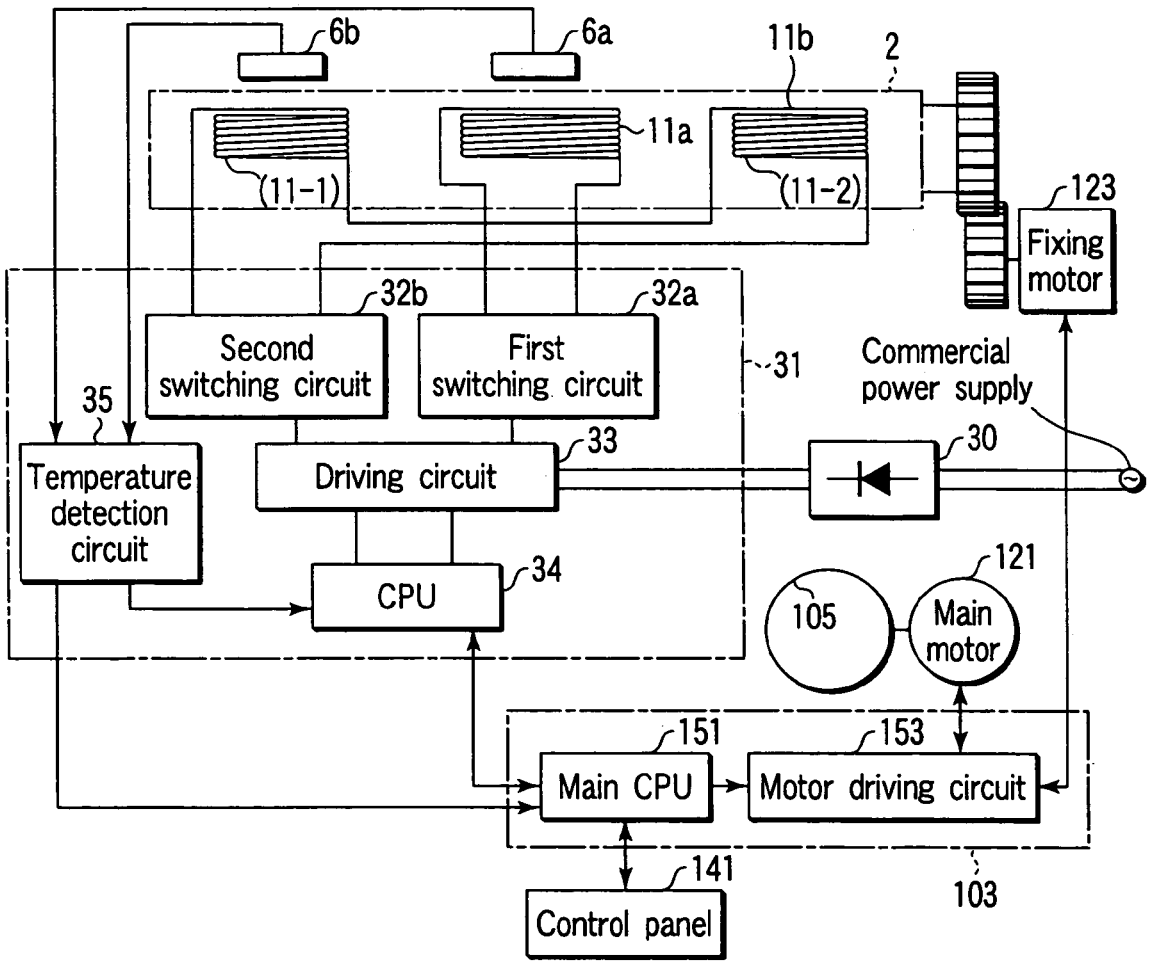
FIG. 3 is a block diagram explaining an example of an exciting unit (a driving circuit) to drive the fixing unit shown in FIGS. 1 and 2.

The fixing roller 2 is rotated at a constant speed by the driving force from a fixing motor 123 shown in FIG. 3 or a main motor 121 the to rotate a photoconductor drum 105, each shown in FIG. 3.

The press roller 3 is made contact with the fixing roller 2 by a predetermined pressure by a pressure mechanism 4, and is rotated together with the fixing roller 2 at a same speed of the fixing roller 2 when the fixing roller 2 is rotated.

Around the fixing roller 2, at least two temperature detection elements 6*a* and 6*b*, a cleaner 7 and a abnormal heating detection element 8 are provided along the rotating direction of the roller 2 and in the direction apart from the nip.

The temperature detection elements 6*a* and 6*b* are thermistors, for example, for detecting the temperature in the outer circumference of the fixing roller 2. At least one of the temperature detection elements is located almost the center in the longitudinally direction of the roller 2. The other one is located at one end in the longitudinally direction of the roller 2. It is allowed to provide three or more thermistors if necessary.

The cleaner 7 eliminates the toner adhered to the fluoric resin provided to the predetermined thickness in the outer circumference of the fixing roller 2, the paper dust generated from paper or the suspended dust particles inside of the unit and adhered to the fixing roller 2. The cleaner 7 includes a cleaning member made of the material, such as felt or fur brush, hard to damage the fluoric resin layer even when contacting the fixing roller 2, and a support member which supports the cleaning member. It is also allowed to make the cleaning member contact and rotate with the surface of the fixing roller 2, or to make press contact with the outer circumference of the fixing roller 2 by a predetermined pressure.

The abnormal heating detection element 8 is a thermostat, for example, which detects abnormal heating of the surface of the fixing roller 2, and is used to shut off the power to the heating coil to be explained later, when abnormal heating occurs.

The position and order of locating the temperature detection elements 6*a* and 6*b*, cleaner 7 and abnormal heating detection element 8 are not to be restricted to those indicated in FIG. 1.

In the circumference of the press roller 3, a cleaning roller 10 is provided to eliminate the toner adhered to the circumference of the roller 3 and separation claw 9 which separates the paper P from the press roller 3.

Inside of the fixing roller 2, an exciting coil 11 is provided to generate an eddy current in the material of the roller 2. The exciting coil 11, in the example shown in FIG. 2, includes a first coil 11*a* located at almost the center in the longitudinally direction of the fixing roller 2, and a second coil 11*b* provided close to both ends of the roller 2.

The second coil 11*b* is the coil made by winding the coil material with almost the same resistance rate and sectional area (twisting wire number) as those of the first coil 11*a*, by the number of turns almost equal to the number of turns of the first coil 11*a*. The second coil 11*b* is located at both ends in the axial direction of the roller 2, across the first coil 11*a*. The second coil 11*b* includes two parts located at both ends of the first coil 11*a*, which are connected in series. Therefore, the second coil 11*b* as a whole can output the power substantially equivalent to the first coil 11*a*. (When it is necessary to identify each coil part of the second coil 11*b*, refer each part as a coil 11-1 and a coil 11-2, respectively.)

The first coil 11*a* is formed long enough to heat the width contacting the outer circumference of the roller 2, when the short side of A4 size paper, for example, is fed parallel to the axis of the fixing roller 2. The second coil 11*b* is useful for heating the area close to both ends of the fixing roller 2.

The first and second coils 11*a* and 11*b* are made of the litz wire which is made by twisting by desired turns the wire material made by covering a copper wire with a predetermined diameter by a heat-resistant material and insulating each other. In the embodiment of the present invention, the diameter of each wire material of the litz wire is 0.5 mm, and the number of twisted wires is 16 wires. The covering material to insulate each wire material employs polyamide. As mentioned above, using a litz wire for the coils 11*a* and 11*b* decreases the substantial resistance value against a high-frequency current, since the wire diameter can be made smaller than the permeation depth of the skin effect generated when a high-frequency current flows in each wire material, the power supplied to each coil can be effectively used.

The coils 11*a* and 11*b* are surrounded in the embodiment of the present invention, around a core 12 made of magnetic material and formed into a predetermined shape as shown in FIG. 1. Use of the core 12, the magnetic flux generated from the coils is enhanced and output level of the magnetic flux is kept even with the less number of turns.

FIG. 3 is a block diagram explaining an example of an exciting circuit to supply a predetermined high frequency current to the exciting shown in FIGS. 1 and 2.

As shown in FIG. 3, the center part of exciting coil 11 or the first coil 11*a* is connected to a first switching circuit (inverter circuit) 32*a* of the exciting unit 31. The both ends of exciting coil 11 or the second coil 11*b* are connected to a second switching circuit (inverter circuit) 32*b*.

The inverter circuits 32*a* and 32*b* switches the DC voltage supplied from a power circuit 30 based on the driving frequency instructed from a driving circuit 33, and supply the voltage to the coils 11*a* and 11*b*. The driving frequency instructed to the inverter circuits 32*a* and 32*b* is set by a CPU 34 based on the temperature condition to be explained later, 20 kHz to 50 kHz, for example. Therefore, the coils 11*a* and 11*b* can output a high frequency power 700 W to 1.5 kW to increase the temperature of the fixing roller 2 to a predetermined level.

When the inverter circuits (the first and second switching circuits 32*a* and 32*b*) are used, the power supplied to the coils (11*a* and 11*b*) built in the circuits depends on the magnitude of the high frequency current flowing in the coils. The magnitude of the high frequency current is set by changing the ON time of the switching element of the inverter circuits. Namely, the magnitude of the power supplied to each coil is changed based on the ON/OFF timings of the switching element instructed by from the CPU 34 to the driving circuit 33. The magnitude of the power changes based on the ON/OFF timings of the switching elements, it will be called as the power outputted to the coils hereinafter.

The driving circuit 33 supplies the rectifier output from the power circuit 30 to only one of the first and second inverter circuits 32*a* and 32*b*. Namely, the driving circuit 33 functions also as a driving switch to supply a predetermined power to one of the two coils 11*a* and 11*b*.

The magnitude of the power applied to the coils 11*a* and 11*b* is, as explained above, set optionally by changing the ON time of the switching element to be inputted from the driving circuit 33. But, in this embodiment, to avoid the interference noise upon switching with the circuit 33 or the influence to the surrounding lighting equipment, the magnitude of the power is set so that the variation in the power becomes 30% maximum, preferably 20% maximum or 10% or lower.

The driving frequency or frequency of current flowing the coils instructed to the inverter circuits 32*a* and 32*b* is set by the CPU 34 based on the temperature data that is outputted by a temperature detection circuit 35 and indicates the temperature around the center of the outer circumference of the fixing roller 2 detected by the first thermistor 6*a*, and the temperature data that indicates the temperatures at both end parts of the roller 2 detected by the second thermistor 6*b*, and is instructed to the driving circuit 33. Further, based on the temperature difference outputted by the temperature detection circuit 35, a motor pulse is supplied from a main CPU 151 in an image forming apparatus, i.e., a copying machine (not shown), to a fixing motor 123 or a motor driving circuit 153 for rotating the heating roller 2.

The relation between the output and temperature data or the timing of switching by the driving circuit 33 to supplying power to the first and second inverter circuits 32*a* and 32*b*, are previously stored in a data storage (rewritable memory, not-shown). The data stored in the data storage is optionally rewritable according to the power supply conditions in the countries or districts to install the copying machine, or the enterable maximum power value allowed by the copying machine.

The main CPU 151 can detect an error in the temperature detection circuit 35 or thermistors 6*a* and 6*b* and, based on the temperature difference outputted from the temperature detection circuit 35. Namely, when an error occurs in the temperature detection circuit 35 (or thermistors 6*a* and 6*b*) when it becomes necessary to shut off the power supply to the coil to increase the temperature of the heating roller 2 caused by a paper jam or other reasons in an image forming unit 103, the CPU 151 can input the control or instruction to the CPU 34 to stop the driving instruction from the driving circuit 33 to each switching circuit.

As a method of supplying predetermined power to the first and second coils of the fixing roller of the fixing unit by using the exciting circuit shown in FIG. 3, it is basically impossible to supply power simultaneously to the first coil 11*a* (center) and second coil 11*b* (ends).

Namely, in this embodiment, the predetermined power is supplied to only one of the coils, or temporarily supplied to neither coil. The magnitude of the power supplied to the first and second coils 11*a* and 11*b* is set almost equal. Generally, when the predetermined power is supplied alternately to the first and second coils 11*a* and 11*b* and the temperature close to the center of the roller 2 reaches the preset target value, the power supply to all coils can be stopped temporarily until the temperature close to the center of the roller 2 decreases a predetermined value lower than the preset target value.

It is possible to supply power to all coils at the same time. However, in this case, it is necessary to provide each coil with a power detection device to detect the power outputted from the coil. Thus, as explained above, it is preferable to supply power to only one of the coils. When the frequency difference of the power supplied to each coil exceeds the predetermined range, an interference noise occurs as explained before, and a voltage fluctuation occurs in the specified range of commercial power (AC power) line connected to the copying machine, causing a flicker. Thus, when the coil is switched while the power is supplied, it is preferable to set the power supplied to each coil almost equal.

Figure 4:
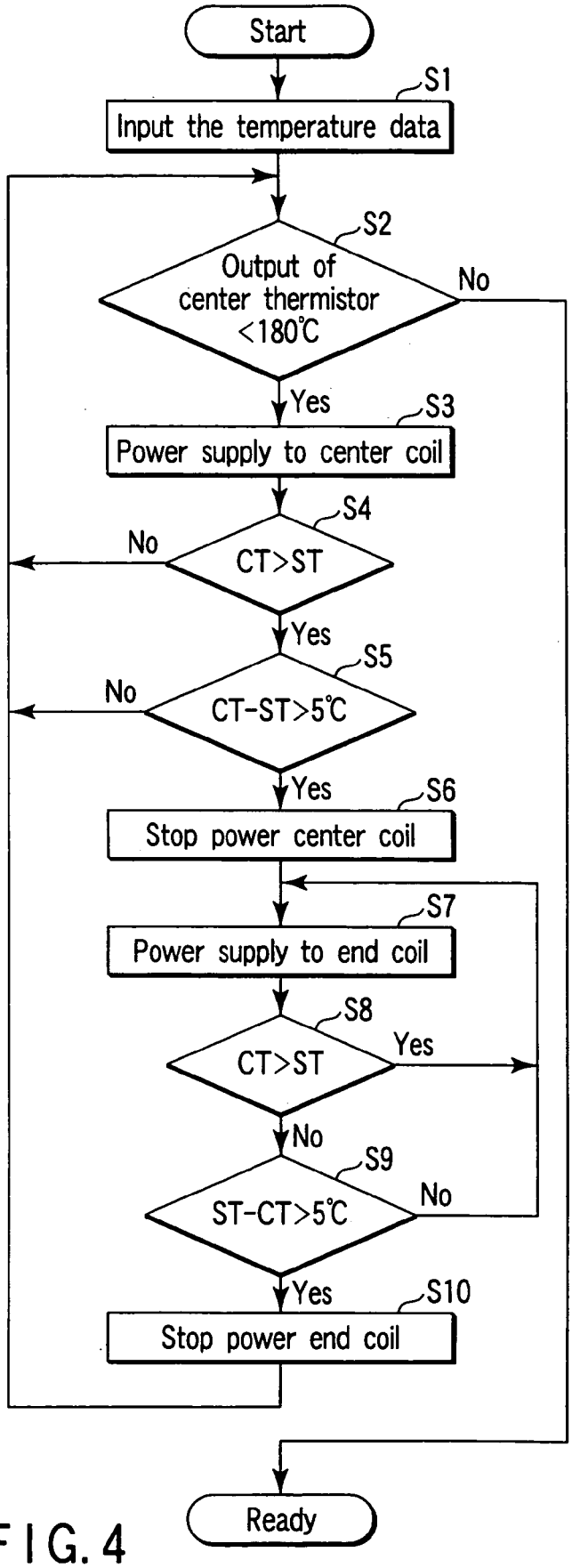
FIG. 4 is a flow chart explaining an example of a method for excitation of the fixing unit of the invention shown in FIGS. 1 to 3.

Next, description will be given on a method of selecting a coil to supply predetermined power and increasing the temperature of a heating roller;

As shown in FIG. 4, when a not-shown power switch of the copying machine not described in detail is turned on, the first and second thermistors (temperature detection mechanisms) 6*a* and 6*b* detect the temperatures of the corresponding parts of the fixing roller 2. Namely, the thermistor 6*a* detects the temperature close to the center in the longitudinally direction of the roller 2, and the thermistor 6b detects the temperature at the end in the longitudinally direction of the roller 2. The outputs of the thermistors 6*a* and 6*b* are applied to the temperature detection circuit 35 (S1).

The temperature data CT which is outputted from the temperature detection circuit 35 and indicates the temperature close to the center of the roller 2, and the temperature data ST which indicates the temperature at the end of the roller 2, are outputted to the CPU 34 and the main CPU 151. In the CPU 34, the temperature data CT is first compared with the preset target value read from a not-shown memory. The preset target temperature is 180° C., for example. (S2) When the temperature data CT is lower than the preset target value (S2—YES), the CPU 34 instructs the driving circuit 33 to supply power with a predetermined frequency to the first coil 11*a*. When the temperature at the center of the roller 2 has reached the preset target value (S2—NO), the power supply to the coil 11*a* is stopped as explained later, and the unit goes into a ready mode (the warming up is finished).

In the step S2—YES, the driving circuit 33 applies a predetermined driving frequency to the first inverter circuit 32*a*, and the first inverter circuit 32*a* switches the DC voltage from the power circuit 30 and supplies to the first coil 11*a* (S3).

Next, the temperature close to the center of the roller 2 (the temperature data CT) is checked whether it is higher than the temperature at the end of the roller 2 (the temperature data ST) (S4). When the temperature close to the center of the roller 2 is detected lower than the temperature at the end in step S4 (S4—NO), the power supply to the first coil

11*a* or the heating at the center of the roller 2 is continued, until the temperature at the center of the roller is higher than the temperature of the end of the roller.

When the temperature at the center of the roller 2 is detected higher than the temperature at the end of the roller 2 (S4—YES), the temperature difference CT−ST in the longitudinally direction of the roller 2 is detected. The temperature difference CT−ST is set to 5° C, for example (S5).

In step S5, when the temperature difference between the center and the end of the roller 2 is detected 5° C. or higher (S5—YES), the power supplied to the coil 11*a* is shut off by the driving stop instruction from the CPU 34 to the driving circuit 33 (S6).

Contrarily, when the temperature difference between the center and the end of the roller 2 is detected 5° C. or lower in step S5 (S5—NO), the power is continuously supplied to the coil 11*a* (the center of the roller 2 is heated).

In step S6, when the power supply to the first coil 11*a* is stopped, the power almost equal to the power supplied to the first coil 11*a* is supplied to the second coil 11*b* by the switching of the second inverter circuit 32*b* according to the instruction (setting the driving frequency) from the driving circuit 33 (S7).

Thereafter, whether the temperature at the end of the roller 2 (the temperature data ST) is higher than the temperature close to the center of the roller 2 (the temperature data CT) is checked (S8).

When the temperature at the end of the roller 2 is detected higher than the temperature close to the center in step S8 (S8—YES), whether the temperature difference between them ST−CT is higher than 5° C. is checked (S9).

When the temperature at the end of the roller 2 is detected higher than the temperature at the center in step S9 (S9—YES), the CPU 34 instructs the driving circuit 33 to stop supply of power to the coil 11*b* (S10). Therefore, when the temperature at the center of the roller 2 reaches 180° C. and the temperature difference between the center and the end of the roller 2 exceeds 5° C., the power supply to all coils is temporarily stopped.

When the temperature at the end of the roller 2 is detected lower than the temperature at the center in step S8 (S8—NO), and when the temperature difference ST−CT is 5° C. or lower in step S9 (S9—NO), it is of course that the predetermined power is continuously supplied to the coil 11*b*.

In the driving (power control) method shown in FIG. 4, the power is supplied first to the first coil 11*a* which increases the center in the longitudinally direction of the roller 2, and when the temperature at the center of the roller 2 is increased to a certain temperature higher than the temperature at the end of the roller 2 detected at the position opposite to the second coil 11*b* which increases the temperature at the end in the longitudinally direction of the roller, the power supply to the center coil 11*a* is stopped, and the predetermined power is supplied to the end coil 11*b*. When the temperature close to the center in the longitudinally direction of the roller 2 reaches 180° C., the power supply to all coils is once interrupted without checking the temperature at the end.

By repeating the above-mentioned control, the temperatures at the center and the end of the roller 2 can be rise equal.

In the above-mentioned driving method, as to the preset target temperature (180° C.) of the roller 2, it is possible to increase the temperature of the roller 2 to be almost equal (180° C.) either by controlling the power supply based only on the detection result by the thermistor 6*a* provided close to the center of the roller 2, or by controlling the power supply based only on the detection result by the thermistor 6*b* provided at the end of the roller 2. In this case, the temperature at the end of the roller 2 temporarily exceeds 180° C., but the temperature is controlled so that the difference between the temperature CT at the center of the roller and the temperature ST at the end of the roller does not exceeds 5° C., and the temperature in a specific part of the roller will not rise extremely.

Of course, when the temperatures at the center and the end of the roller 2 reach the preset target temperatures, the power supply from the inverter circuits 32*a* and 32*b* to the corresponding coils, or the input of the driving frequency from the driving circuit 33 to the inverter circuits 32*a* and 32*b*, is stopped, and the temperatures at all parts of the roller 2 is held almost equal.

Figure 5:
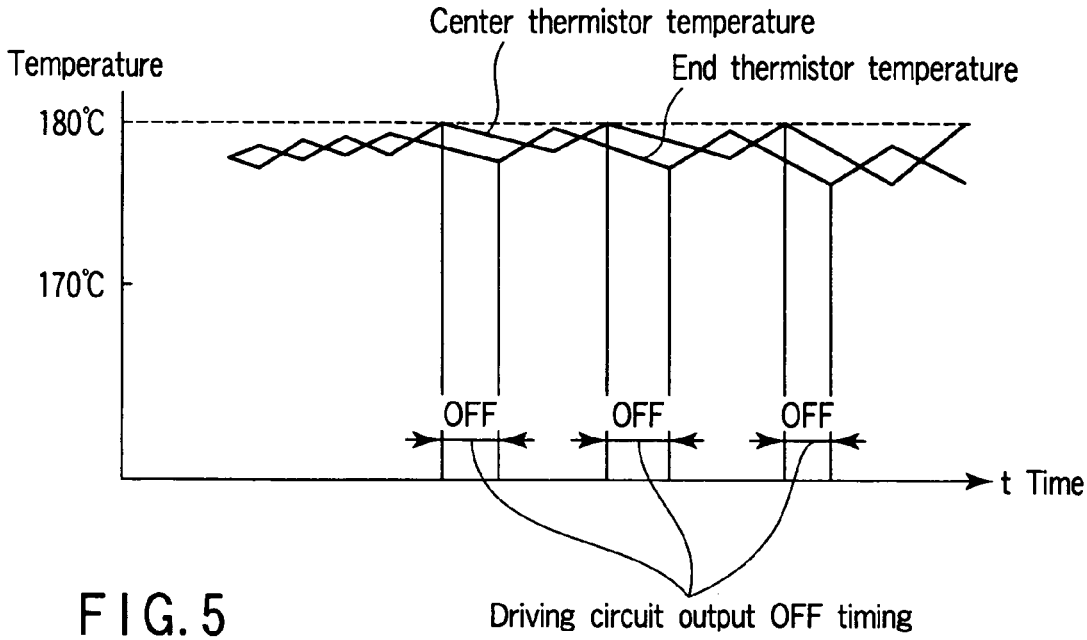
FIG. 5 is a graph explaining the change in the roller temperature by another method for excitation of the fixing unit of the invention shown in FIGS. 1 to 3.
Figure 6:
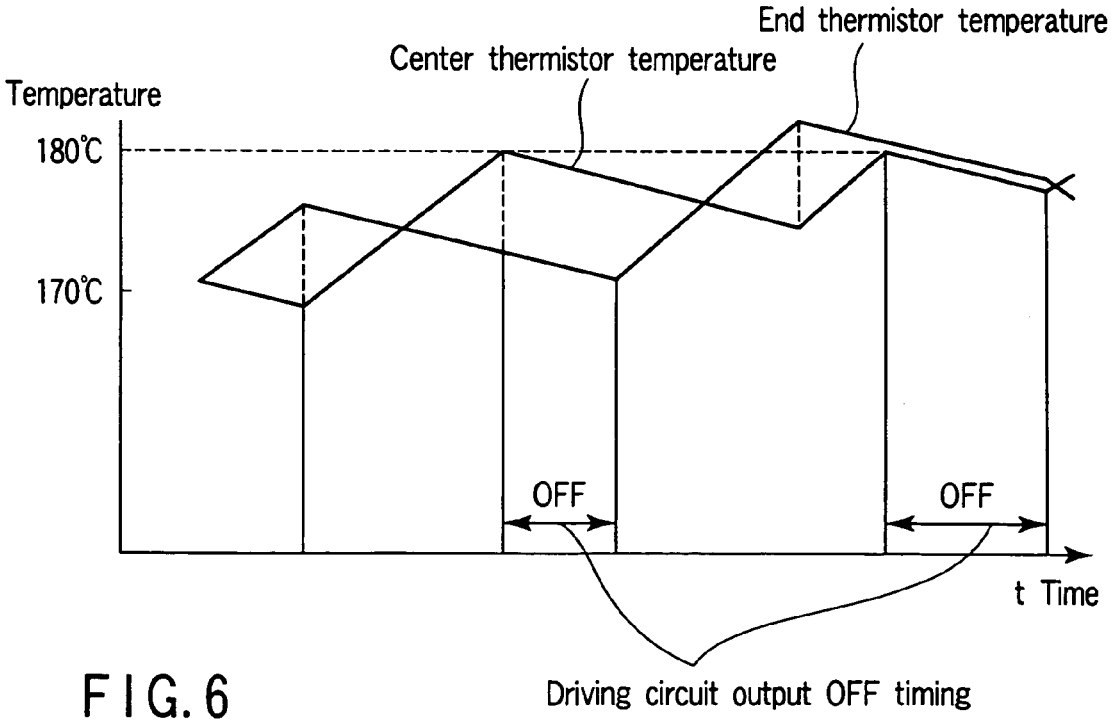
FIG. 6 is a graph explaining the change in the roller temperature by still another method for excitation of the fixing unit of the invention shown in FIGS. 1 to 3.

FIGS. 5 and 6 are the graphs explaining an example of applying the timing of switching the coil to supply power explained by referring to FIG. 4, to the operation state of the copying machine.

In the driving method shown in FIG. 5, when the difference between the temperature data CT at the center of the roller 2 and the temperature data ST at the end of the roller 2 from the temperature detection circuit 35 reaches 3° C., the CPU 34 instructs the driving circuit 33 to switch the coil to which the power is supplied. Namely, when the temperature at the center of the roller 2 reaches 180° C., the power supply to all coils is stopped, and when the difference between the temperatures at the center and the end of the roller 2 reaches 3° C., the predetermined power is supplied again to any one of the coils. Therefore, a ripple in the temperature distribution (an uneven temperature) in the longitudinally direction of the roller 2 can be suppressed to small. Further, this driving method is suitable when increasing the temperature of the fixing roller 2 up to the preset target value from the time when the power of a copying machine is turned on (warming up), or when passing paper between the rollers 2 and 3 as when forming an image with a copying machine. For example, when passing paper or forming an image and when warning up, a large energy is required to hold the temperature of the roller 2 or to increase the temperature of the roller 2 up to a predetermined value, and a large power close to the upper limit of the enterable power is demanded. Therefore, even if the control value (temperature difference) is set to 3° C., the power supply to the coils 11*a* and 11*b* is often switched, but the power supply from the power circuit 30 is rarely stopped by the driving circuit 33.

Since the driving circuit 33 rarely stops the power from the power circuit 30, a voltage fluctuation rarely occurs in the same commercial power circuit connected to the copying machine, causing a flicker in the fluorescent lamp (illumination) in the same circuit. Since the temperature difference in the longitudinally direction of the roller 2 is little, a temporary drop in the fixing performance occurs seldom.

On the other hand, as seen from FIG. 5, it is obvious that the coil to which power is supplied is often switched, by setting the temperature difference (control value) between the center and end of the roller 2 to 3° C. when the coil to which the power is supplied is switched.

In this case, a ripple in the temperature distribution in the roller can be decreased, and a fixing performance drop is seldom, as described above. For example, after the temperature at the center in the longitudinally direction of the roller 2 reaches 180° C., in the standby state waiting for the input for image forming, the number of times to turn on/off each inverter circuit is increased.

More specifically, when switching alternately the coils to be supplied with power, if the temperature difference or the control value to switch the coils is set to 3° C., the coil to be supplied with power is not switched under the condition where the roller temperature is hardly lowered, and the driving circuit 33 repeats the input or shut-off of the DC voltage from the power circuit 30, as explained by referring to FIG. 3. Therefore, a voltage fluctuation may occur in a commercial power circuit connected to the copying machine, and a flicker may occur in the fluorescent lamp (illumination) in the same circuit.

Thus, in the standby state, for example, the timing or the control value (temperature difference) to switch the coils to be supplied with power is set to 6° C., as shown in FIG. 6.

As shown in FIG. 6, the timing to switch the coils to be supplied with power is 6° C. in the temperature difference between the center and the end in the longitudinally direction of the roller 2.

In this case, since the time to continuously supply power to the coil is long, and the ripple itself in the temperature distribution in the roller is increased.

For example, when the temperature at the center of the roller reaches 180° C. in the state the power is being supplied to the coil 11*a* which increases the temperature at the center of the roller 2, the input of DC voltage to the coils 11*a* and 11*b* from the power circuit 30 is shut off. Therefore, the temperature at the end of the roller is held low compared with the temperature at the center of the roller.

Thus, when the CPU 34 detects that the temperature difference between the center and the end of the roller exceeds 6° C., the power is supplied to the coil 11*b* to increase the temperature of the end of the roller 2.

As explained above, according to the control shown in FIG. 6, the time to supply power to the coil 11*b* is increased compared with the control example, where the temperature difference is little, explained before by referring to FIG. 5. Therefore, this decreases the timing to switch the power supply coil, and the number of turning off the driving circuit 33 which does not to supply DC voltage of the power circuit 30 to any coil. This suppresses the frequency (number) of a flicker in the fluorescent lamp (illumination) in the same circuit, even if it may occur as a result of the voltage fluctuation in the commercial power circuit connected to the copying machine.

According to the control shown in FIG. 6, compared with the control explained by referring to FIG. 5 (FIG. 4), there is an increase in either the ripple in the temperature distribution in the longitudinally direction of the roller, or the temperature difference between the center and the end of the roller. However, since the fixing performance is not to be considered in the standby state, the merit of decreased flicker can be obtained. Further, since the ripple in the temperature distribution in the longitudinally direction of the roller 2 is to be settled within a certain range, while the paper P is fed between the rollers 2 and 3 after the image forming is instructed, the power consumption is also reduced.

As explained above, by changing the temperature difference (control value) for setting the timing of switching the power to be supplied to the coil 11*a* which increases the temperature at the center of the roller 2, and the coil 11*b* which increases the temperature at the end of the roller 2 of the fixing unit 1, according to the operation states of the copying machine, it can be suppressed that a flicker occurs in the fluorescent lamp in the same circuit as a result of a voltage fluctuation in the commercial power supply connected to the copying machine.

FIGS. 4 to 6 explain the example where the operation state of the copying machine is monitored, and the coil to be supplied with power is switched. It is also allowed to change the timing of switching the coil to be supplied with power, according to the roller temperature, for example.

For example, when the both temperatures of the center and ends of the roller 2 are greatly lower than the preset target value (e.g., 180° C.), it is assumed during temperature increase (worming up) different from the image forming operation, and the timing of switching the coil to be supplied with power may be rough (the temperature difference level).

On the contrary, when the temperature detected by the thermistors 6*a* and 6*b* is close to the preset target temperature, it is assumed during the fixing operation (image forming operation), and the timing of switching the coil to be supplied with power should be minute, preferably suppressing the ripple in the temperature distribution in the longitudinally direction of the roller 2.

Figure 7:
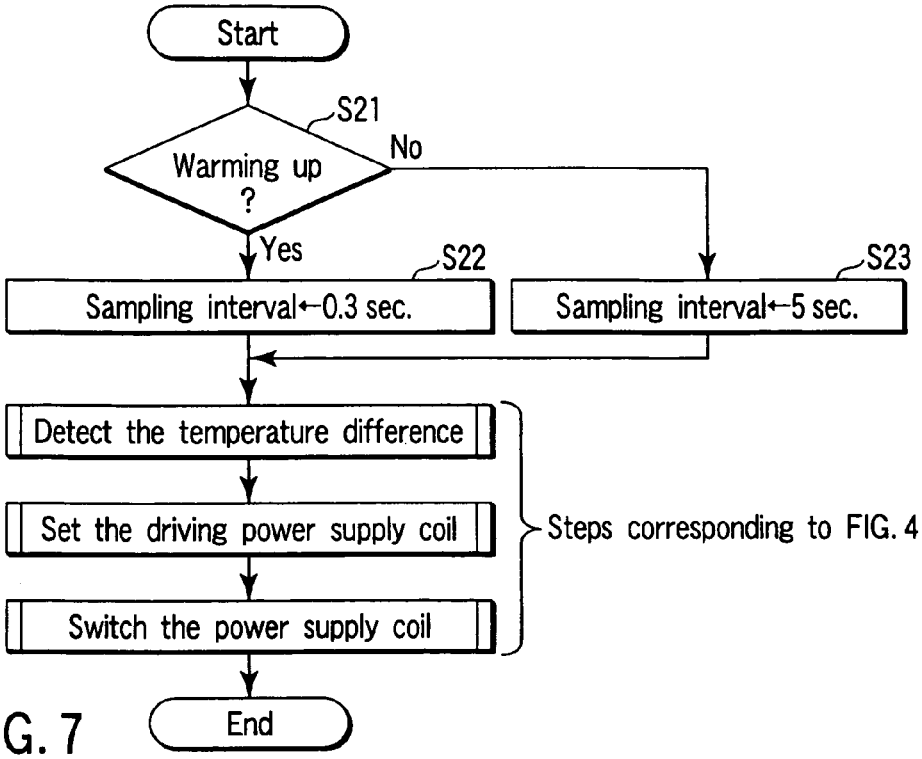
FIG. 7 is a flow chart explaining another example of a method for excitation of the fixing unit shown in FIGS. 1 to 3.

FIG. 7 is a flow chart explaining an example of temperature control different from the method of increasing the temperature of the heating roller explained before by referring to FIGS. 4 to 6. The temperature control explained hereinafter by referring to FIG. 7 relates to the sampling of the temperature information used for switching the timing to supply the predetermined power to the coils which increase the temperatures of the center and end of the roller to increase the temperature of the roller explained already by referring to FIG. 4.

As shown in FIG. 7, the operation state of a copying machine (not shown) is check first, and then the state when the power switch (not shown) of the copying machine is turned on, or the standby state after turning on of the power switch to the end of the initial operation after a certain time, or the image forming operation while the paper is fed between the heating roller and the press roller after the image forming is instructed, will be checked (S21). The image forming operation can be divided into the fixing when the paper exists between the rollers, and the interval when the paper does not exist between the rollers. Therefore, it is sufficient to divide according to whether the power is being supplied to the coil to increase the temperature of the roller 2. whether the paper exists during the image forming operation, is not a matter here. Though not explained in detail, the standby state includes power-saving mode for keeping the roller temperature lower than the temperature during ordinary standby mode.

When the operation state of the copying machine checked in step S21 is in the image forming state, the standby state after the power switch is turned on, or the warming up state before the image forming state (S21—YES), the interval that the temperature information entered through the temperature detection circuit 35 and outputted from the first and second thermistors 6*a* and 6*b*, is taken into the CPU 34 of the exciting unit 31 and the main CPU 151 (sampling) is set to 0.3 second, for example (S22).

Therefore, the timing of supplying power to (or stopping the driving) the coil which increases the temperature at the center or the end of the roller 2 and the timing of switching the coil to be supplied with power, are set based on the temperature difference in the longitudinally direction of the roller 2 detected at every 0.3 second. As a result, the temperature difference between the center and the end of the roller is made almost equal in the state where paper is not fed. The temperature information sampling (taking-in) interval can be set to a predetermined time, 0.5 through 1 second, for example, based on the coil characteristics (the coil diameter, the winding radius, the number of turns, the core material, etc.) and the power supplied to the coil.

On the other hand, when the operation state of the copying machine checked in step S21 is the standby state which belongs to neither the image forming state nor the warming-up state (S21—NO), the interval of taking the temperature information, which is entered through the temperature detection circuit 35 and outputted from the first and second thermistors 6*a* and 6*b*, into the CPU 34 (the main CPU 151) is set to 5 seconds (S23).

In this case, the temperature difference between the center and the end of the roller becomes larger than that when the temperature difference is detected with the shorter interval as explained in step S22, but, as the operation state is the standby state, it is unnecessary to consider the fixing performance strictly, because of the reason explained before by referring to FIG. 6. Therefore, there is a merit that a flicker can be reduced.

The ripple in the temperature distribution of the roller is also increased, but the power consumption is also decreased, because the ripple can be settled within a certain range before the paper is fed between the rollers 2 and 3 after the image forming is instructed.

The temperature information sampling interval (time) is set to a value to permit restoring the temperature distribution in the longitudinally direction of the roller 2 to the temperature difference which does not influence the fixing performance, during the period from the image forming instruction to the paper feeding between the rollers 2 and 3, based on various parameters including the maximum power applicable to the coil, the coil characteristics (coil diameter, the winding radius, the number of turns, the core material, etc.), and the material and thickness of the roller 2.

As described above, changing the timing of sampling the temperature information from the first and second thermistors 6*a* and 6*b* shown in FIG. 7 is equivalent to the changing of the timing of supplying power to the coil.

When heating is necessary as in the image forming state or during warming up, the ripple occurred in the temperature distribution in the longitudinally direction of the roller can be decreased by reducing the interval of detecting the temperature difference in the longitudinally direction of the roller. Namely, the temperature distribution is made uniform in all area in the longitudinally direction of the roller, and the fixing performance is improved.

Contrarily, in the standby state and the power-saving mode, by allowing an ripple in the temperature distribution in the longitudinally direction of the roller, the frequency (the number) of flickers can be decreased, even if a flicker occurs in the illumination in the same circuit caused by the fluctuation of the output as a result of a temporarily power failure to the coil.

The shortest time (interval) 0.3 second of the timing to detect the temperature difference is determined by the fact that about 0.5 second is required to stabilize the output of the coil to which the power is supplied (until the coil output reaches the target value). Namely, when switching the coil to be supplied with power at a cycle of 0.5 second or shorter, the coil output may not reach the target value. Thus, it must be avoided to switch the coil at an extremely short cycle. Further, 0.2 through 0.3 second is required to feed back to the driving circuit 33, after obtaining the temperature difference from the temperatures detected by the first and second thermistors 6*a* and 6*b*. Therefore, in the present invention, the shortest interval (cycle) of timing to detect the temperature difference is set to 0.3 second.

In FIG. 7, the example of switching the coil to be supplied with power is explained in connection with the operation states of the copying machine. It is also permitted to change the timing of switching the coil to be supplied with power according to the roller temperature, for example.

Taking one example, when both temperatures of the center and the end of the roller are extremely lower than the preset target value (180° C. in the copying machine of the present invention), it is assumed during warming up, and the timing of switch the coil may be rough.

On the contrary, when the temperature detected by the thermistors 6*a* and 6*b* is close to the preset target temperature, it is assumed during the fixing operation, and the timing of switching the coil to be supplied with power should be minute, preferably suppressing the ripple in the temperature distribution in the longitudinally direction of the roller 2.

Figure 8:
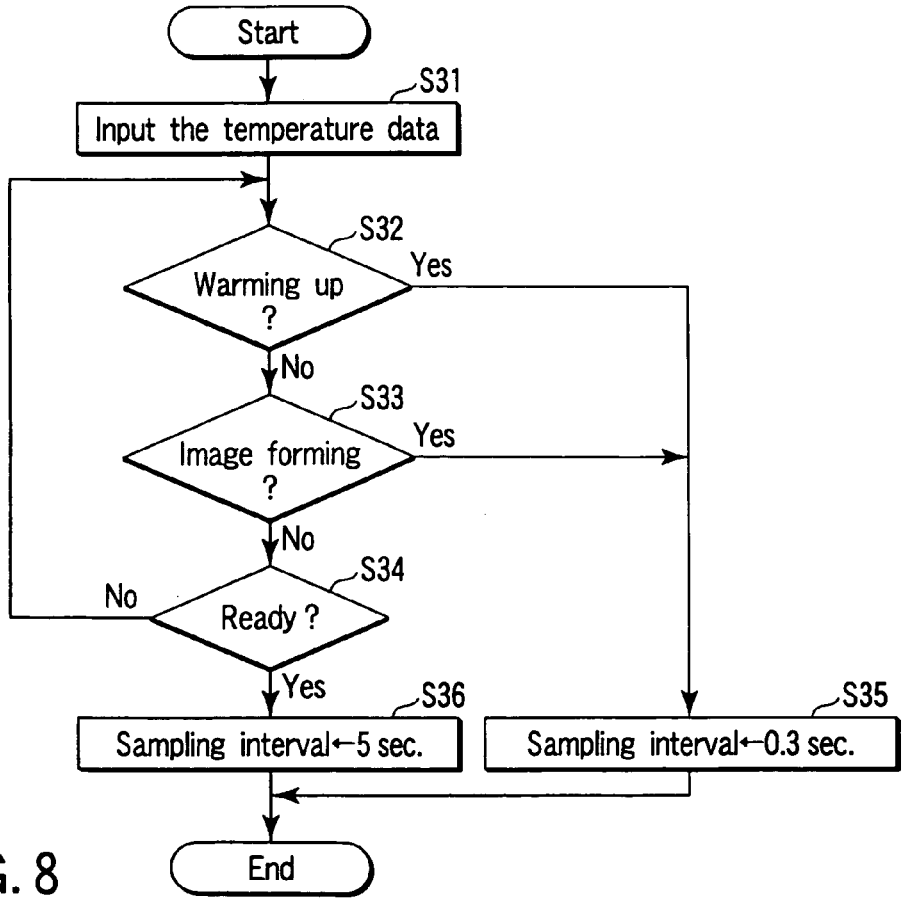
FIG. 8 is a flow chart explaining still another example of a method for excitation of the fixing unit shown in FIGS. 1 to 3.

FIG. 8 is a flow chart explaining a modification of the above-mentioned example to increase the temperature of the heating roller.

As shown in FIG. 8, when the operation state of the copying machine is the state where the power switch (not shown) of the copying machine is turned on, the warming up state till the end of the initialization after the temperature of the heating roller 2 is increased to a predetermined value, the image forming operation with the paper fed between the heating roller and the press roller after the image forming is instructed, or the standby state until the next image forming is instructed after the end of the warming up or image forming, the temperatures at the center and the end of the roller 2 detected by the first and second thermistors 6*a* and 6*b* are continuously applied as temperature information to the CPU 34 and the main CPU 151 at a predetermined time interval (S31). The timing that the outputs of the thermistors 6*a* and 6*b* are taken in the CPU 34 and main CPU 151, is 0.1 second (100 msec), for example. In step S31, when the temperature information is continuously applied to the CPU 34 and main CPU 151 of the copying machine, the main CPU 151 checks whether the copying machine is now warming up (S32), forming an image (S33) or standing by (S34).

In step S32, when the warming up of the copying machine is detected (S32—YES), the main CPU 151 indicates the CPU 34 of the exciting unit 31 that the sampling interval of detecting the temperature difference to instruct power supply to the coil for the driving circuit 33 is 0.3 second (S35).

In step S33, when the image forming of the copying machine is detected (S33—YES), like in step S32—YES, the main CPU 151 indicates the CPU 34 of the exciting unit 31 that the sampling interval of detecting the temperature difference to instruct power supply to the coil for the driving circuit 33 is 0.3 second (S35).

In step S34, when the standby of the copying machine is detected (S34—YES), the main CPU 151 indicates the CPU 34 that the sampling interval of detecting the temperature difference to instruct power supply to the coil for the driving circuit 33 is 5 seconds (S36). Even if the copying machine is not warming up (S32—NO) or not forming an image (S33—NO), the main CPU 151 indicates the CPU 34 that the sampling interval of detecting the temperature different to instruct power supply to the coil for the driving circuit 33 is 5 seconds (S36).

Needless to say, the operations states are checked in the order of the above-mentioned steps.

As described above, in the control shown in FIG. 8, after sampling the temperature information from the first and second thermistors 6*a* and 6*b*, the timing of obtaining the temperature difference from the temperature information is changed according to the operation sates of the copying machine. Changing the timing of obtaining the temperature difference from the temperature information is of course the same as changing the timing to supply power to the coil.

When heating is necessary as in the image forming state or during warming up, the ripple occurred in the temperature distribution in the longitudinally direction of the roller can be decreased by reducing the interval of detecting the temperature difference. Namely, the temperature distribution in the longitudinally direction of the roller is made uniform, and the fixing performance is improved.

Contrarily, in the standby state and the power-saving mode, a ripple is allowed in the temperature distribution in the longitudinally direction of the roller by enlarging the interval to detect the temperature difference, and the frequency (the number) of flickers can be decreased, even if a flicker occurs in the illumination in the same circuit caused by the fluctuation of the output as a result of a temporary power failure to the coil.

In FIG. 8, the example of switching the coil to be supplied with power is explained in connection with the operation states of the copying machine. It is also permitted to change the timing of switching the coil to be supplied with power according to the roller temperature, for example.

Taking one example, when both temperatures of the center and the end of the roller are extremely lower than the preset target value (180° C. in the copying machine of the present invention), it is assumed during warming up, and the timing of switch the coil may be rough. Therefore, even if the timing to obtain the temperature difference in the longitudinally direction of the roller from the temperature information outputted from the two thermistors is enlarged, there occurs no possibility of arising a problem in the fixing performance.

On the contrary, when the temperature detected by the thermistors 6*a* and 6*b* is close to the preset target temperature, it is assumed during the fixing operation, and the timing of switching the coil to be supplied with power should be minute, preferably suppressing the ripple in the temperature distribution in the longitudinally direction of the roller 2.

Figure 9:
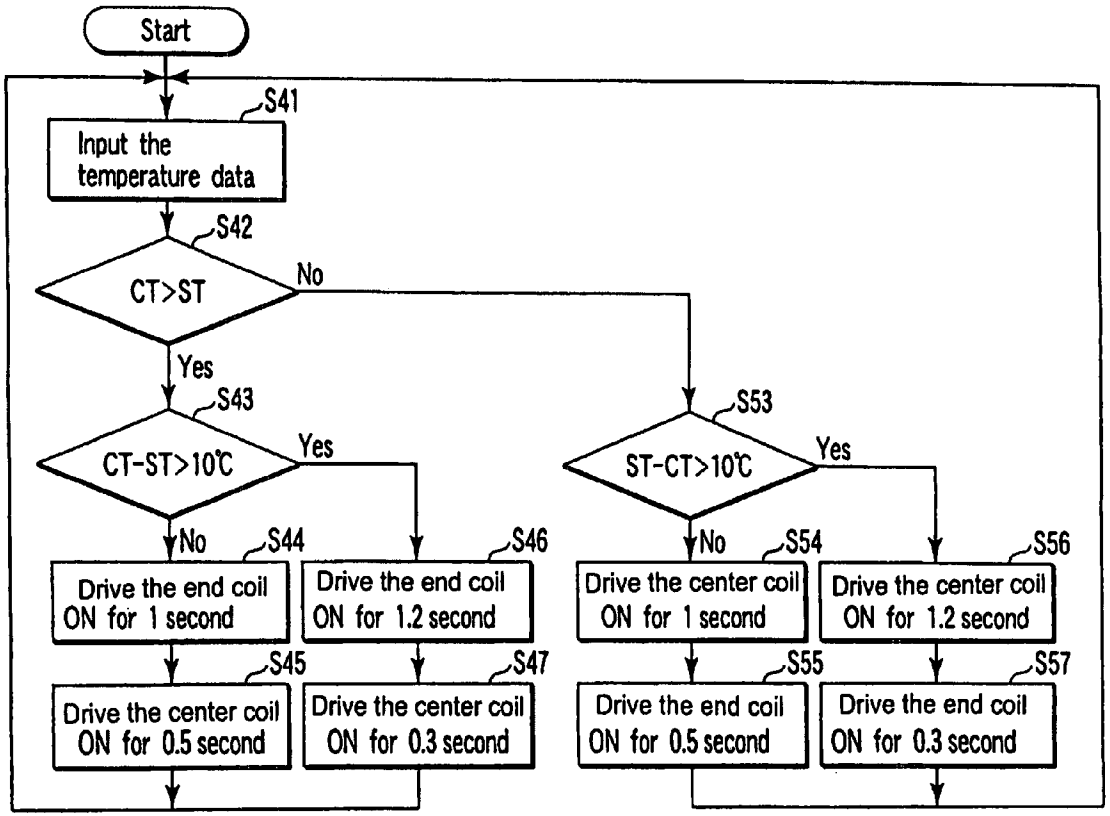
FIG. 9 is a flow chart explaining a further example of a method for excitation of the fixing unit shown in FIGS. 1 to 3.

FIG. 9 is a flow chart explaining still another temperature control different from the above-mentioned method of increasing the temperature of the heating roller. The temperature control of the roller 2 shown in FIG. 9 is applied to the warming-up state mainly from image forming or turning on of the power switch up to reaching of the roller 2 temperature to the preset target temperature. Further, in this example, it is assumed that a predetermined power is alternately supplied in the same time to the coils 11*a* and 11*b* which increase the temperatures at the center and the end of the roller 2. It is also assumed that the total time of the power supply to the coils 11*a* and 11*b* is set equal to the timing (interval) to detect the temperature difference between the center and the end of the roller 2.

As shown in FIG. 9, in the warming up and image forming states before the temperature of the roller 2 reaches the preset target temperature, the temperature information outputted from the first and second thermistors 6*a* and 6*b* is inputted to the CPU 34 at the timing explained before by referring to FIG. 4 (S41).

Next, the CPU 34 compares the temperature data CT which indicates the temperature close to the center of the roller, with the temperature data ST which indicates the temperature at the end of the roller (S42).

In step S42, when the temperature ST at the end of the roller is less than the temperature CT at the center of the roller (S42—YES), the process proceeds to step S43. In step S43, it is determined whether the temperature CT at the center of the roller is 10° C. or more higher than the temperature ST at the end of the roller.

In step S43, when the temperature CT at the center of the roller is 10° C. or more higher than the temperature ST at the end of the roller (S43—YES), the time to supply power to the coil 11*b*, which increases the temperature at the end of the roller, is set to 1.2 seconds, for example. In addition, the time to supply power to the coil 11*a*, which increases the temperature at the center of the roller, is set to 0.3 seconds (S46, S47).

In step S43, when the temperature CT at the center of the roller is higher than the temperature ST at the end of the roller, but the temperature difference is 10° C. or lower (S43—NO), the time to supply power to the coil 11*b*, which increases the temperature at the end of the roller, is set to 1 second, for example. In addition, the time to supply power to the coil 11*a*, which increases the temperature at the center of the roller, is set to 0.5 seconds (S44, S45).

Contrarily, in step S42, when the temperature CT at the center of the roller is less than the temperature ST at the end of the roller (S42—NO) the process proceeds to step S53. In step S53, it is determined, whether the temperature ST at the end of the roller is 10° C. or more higher than the temperature CT at the center of the roller.

In step S53, when the temperature ST at the end of the roller is 10° C. or more higher than the temperature CT at the center of the roller (S53—YES), the time to supply power to the coil 11*a*, which increases the temperature at the center of the roller, is set to 1.2 seconds, for example. In addition, the time to supply power to the coil 11*b*, which increases the temperature at the end of the roller, is set to 0.3 seconds (556, S57).

In step 553, when the temperature ST at the end of the roller is higher than the temperature CT at the center of the roller, but the temperature difference is 10° C. or lower (S53—NO), the time to supply power to the coil 11*a*, which increases the temperature at the center of the roller, is set to 1 second, for example. In addition, the time to supply power to the coil 11*b*, which increases the temperature at the end of the roller, is set to 0.5 seconds (S54, S55).

More specifically, in the roller temperature control explained before by referring to FIGS. 4 to 6 or FIG. 7 and FIG. 8, when the timing (cycle) of detecting the temperature difference from the temperatures at the center and the end of the roller is 1.5 seconds, for example, power is supplied to the coil of the lower temperature side, and power is supplied to the same coil during the cycle (interval) of detecting the temperature difference. Therefore, the longer the timing to switch the coil to supply power, the temperature difference in the longitudinally direction of the roller is larger. Contrarily, to reduce the temperature difference in the longitudinally direction of the roller, it is effective to reduce the interval of switching the coil to supply power, as explained before.

Accordingly, in the power supply to the coil shown in FIG. 9, power is supplied to the coil of the lower temperature side, but the time to supply power is shorter than the timing to detect the temperature difference. For example, as explained in steps S44 and S45, when the interval to detect the temperature difference is 1.5 seconds, power is supplied to the coil 11*a* which increases the temperature at the center of the roller for the remaining 0.5 seconds after supply power to the coil 11*b* for 1 second.

As previously described, the time to continuously supply a predetermined power to one of the coils 11*a* and 11*b*, which increase the temperatures at the center and the end of the roller 2, is shorter than 1.5 seconds or the cycle to detect the temperature difference (1 second in the above-mentioned example), and the coil switching timing can be made faster. Therefore, the temperature different in the longitudinally direction of the roller 2 can be decreased.

In the above-mentioned example, the interval to detect the temperature difference is 1.5 seconds, and the time to supply a predetermined power to the coils 11*b* and 11*a* is 1.0 second and 0.5 seconds, respectively. If the temperature difference between the center and the end of the roller 2 becomes large even with the above settings, change the ratio of the time to supply power to each coil. For example, the temperature of the center (end) of the roller is higher than the temperature of the end (center) of the roller, the time to supply the power for the center (end) of the coil is decreased. In other words, the temperature detects at the center (or end) of the roller is higher than the temperature detects at the end (or center) of the roller, the power supply to the end (or center) of the roller is increased.

The interval to detect the temperature difference and the ratio of power supply to the coils 11*a* and 11*b* within that interval, can be changed by the serviceman's service mode by using a not-shown specific input key, such as a magnification rate setting key, on a control panel 141. If the power supply ratio can be inputted to the main CPU 151, any executable input method (form) and configuration can be used.

When the temperature difference exceeds 10° C., for example, as shown in steps S46 and 47, power is supplied to the coil 11*b* which raises in the temperature of the end of the roller for 1.2 seconds, and to the coil 11*a* which raises the temperature of the center for the remaining 0.3 seconds, if the interval to detect the temperature difference is set to 1.5 seconds. Only when the temperature difference detected in step S43 is greater than 10° C., the time to supply power to the coils 11*a* and 11*b* is changed. In the standby or power-saving mode, the time to supply power to the coils 11*a* and 11*b* is changed, to 2 seconds for the coil opposite to the lower temperature position of the roller 2, and to 1 second for the other coil. When the temperature exceeds the preset value, as in the other embodiment described above, the power supply to each coil is temporarily stopped.

Power is supplied not only to the coil at low temperature. After power is supplied to this coil, power is supplied also to the other coil for a shorter time than to the coil at low temperature. This reduces the temperature difference between the coils even if the means for detecting the temperatures of the coils cannot respond to temperature changes. As seen from FIG. 9, power is supplied to the center coil for 1 second and power is thereafter supplied to the side coils for 0.5 seconds if the center coil has a lower temperature than the side coils. The center coil may have a higher temperature than the side coils. In this case, power is supplied to the center coil for 0.5 seconds, and then to the side coils for 1 second. Thus, the power ratio between the center coil and either side coil is reversed when the temperature relation between the center coil and either side coil is reversed.

By this method, the switching interval can be extended without changing the ratio (switching timing) to supply power to each coil. Therefore, the number of turning on/off the power supply to the switching circuit by the driving circuit (the number of times to connect the output of the power circuit to the switching circuit by the driving circuit) can be decreased, and a voltage fluctuation can be suppressed.

Namely, this method is useful when a flicker is occurring (or likely to occur), for example. Since the time to continuously supply power to one of the coils (opposite to the higher temperature one) is reduced, the temperature distribution in the longitudinally direction of the roller 2 is made uniform. The embodiment explained using FIG. 9 is particularly useful when the timing to detect the temperature difference is relative slow due to the constant or the other conditions of the temperature detection circuit.

The power supply switching shown in FIG. 9 explains the example of switching the timing to supply power to each coil according to the operation modes of the copying machine, but it is also possible to change the timing according to the temperatures of the roller 2.

For example, when the roller temperature is extremely lower than the preset target value (e.g., 180° C.), it is allowed to extend the time itself to supply power to an optional coil. Contrarily, after the thermistors 6*a* and 6*b* detect that the roller temperature increases close to the preset target value, it is allowed to reduce the timing of switching the coil to supply a predetermined power.

Further, it is also possible to combine the power supply switching control shown in FIG. 9 with the control shown in FIG. 4 through 8. In this time, it is of course allowed to change the above-mentioned control method according to the operation modes of the copying machine.

Further, in the above-mentioned fixing unit of the present invention, the temperature difference condition changing mechanism changes the temperature difference used by the driving control mechanism to define the timing to supply a predetermined power to the first and second coils, according to the operation states where a medium passes through the heating member and the press member, the heating member is being heated, and in a standby state where a medium is not fed between the heating member and the press member for a predetermined time.

Further, in the above-mentioned fixing unit of the present invention, the temperature difference condition changing mechanism changes the temperature difference used by the driving control mechanism to define the timing to supply a predetermined power to the first and second coils, according to the temperatures at the first and second positions of the heating member detected by the first and second temperature detection mechanisms.

Moreover, in the above-mentioned fixing unit of the present invention, the temperature difference condition changing mechanism changes the timing to detect the temperature difference used by the driving control mechanism to define the timing to supply a predetermined power to the first and second coils, according to the operation states where a medium passes through the heating member and the press member, the heating member is being heated, and in a standby state where a medium is not fed between the heating member and the press member for a predetermined time.

Moreover, in the above-mentioned fixing unit of the present invention, the temperature difference condition changing mechanism changes the timing to detect the temperature difference used by the driving control mechanism to supply a predetermined power to the first and second coils, according to the temperatures at the first and second positions of the heating member detected by the first and second temperature detection mechanisms.

Moreover, in the above-mentioned fixing unit of the present invention, the driving switching condition changing mechanism changes the timing of the driving control mechanism to supply a predetermined power to the first and second coils, according to the states where a medium passes through the heating member and the press member, the heating member is being heated, and in a standby state where a medium is not fed between a heating member and a press member for a predetermined time.

Moreover, in the above-mentioned fixing unit of the present invention, the temperature difference condition changing mechanism changes the timing of the driving control mechanism to supply a predetermined power to the first and second coils, according to the temperatures at the first and second positions of a heating member detected by the first and second temperature detection mechanisms.

Moreover, in the above-mentioned fixing unit of the present invention, the temperature difference condition changing mechanism changes the timing of the driving control mechanism to supply a predetermined power to the first and second coils, taking the time until the output of the power supplied coil reaches a predetermined output (saturation), as a minimum cycle.

Moreover, in the above-mentioned fixing unit of the present invention, the power supply mechanism can change the distribution ratio to supply a predetermined power to the first and second coils, when the temperature difference outputted from the temperature detection mechanism is larger than a predetermined temperature difference.

Moreover, in the above-mentioned fixing unit of the present invention, the distribution ratio that the power supply mechanism supplies a predetermined power to the first and second coils, can be changed from the outside.

As explained above, according to the fixing unit of the present invention, it is possible to increase the temperature in the longitudinally direction of the heating roller, with the substantially equal temperature difference in the longitudinally direction, while supplying power alternately to two coils which are provided so that the temperatures at the center and the end of the roller can be independently increased.

Further, according to the fixing unit of the present invention, it is possible to suppress a flicker occurring in the illumination in the commercial power circuit, to which the fixing unit and copying machine are connected.

Further, according to the fixing unit of the present invention, it is possible to suppress occurrence of an interference noise in the image forming unit including a fixing unit of the induction heating system, and to decrease a flicker or the like in the surroundings.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

a heating member that includes a conductive member;

a press member that presses a toner on a medium that passes between the heating member and the press member;

a first coil connected to a first switching circuit, which is provided close to a first position of the heating member;

a second coil connected to a second switching circuit, which is provided close to a second position of the heating member;

a driving circuit that controls the first and second switching circuits;

a first temperature detector that outputs a temperature at the first position;

a second temperature detector that outputs a temperature at the second position; and a temperature difference detection mechanism that compares the outputs from the first and second temperature detectors, wherein the temperature difference detection mechanism is configured to switch sampling cycles according to whether the fixing device is in a warm-up state, is forming an image, or is in a standby state.

2. The fixing device according to claim 1, wherein the driving circuit alternately drives the first and second switching circuits.

3. The fixing device according to claim 2, wherein a period for which the first and second switching circuits are alternately driven is changeable.

4. The fixing device according to claim 3, wherein when the output from the first detector is greater than the output from the second detector, the driving circuit is configured to control the first and second switching circuits in such a manner that the period for which the second switching circuit is on is made longer than the period for which the first switching circuit is on.

5. The fixing device according to claim 3, wherein when the output from the second detector is greater than the output from the first detector, the driving circuit is configured to control the first and second switching circuits in such a manner that the period for which the first switching circuit is on is made longer than the period for the second switching circuit is on.

6. The fixing device according to claim 4, wherein when the difference between the outputs from the first and second detectors is greater than a predetermined difference, the driving circuit is configured to control the first and second switching circuits in such a manner that the period for which the second switching circuit is on is made longer as compared with a case in which the difference is smaller than the predetermined difference.

7. The fixing device according to claim 5, wherein when the difference between the outputs from the first and second detectors is greater than a predetermined difference, the driving circuit is configured to control the first and second switching circuits in such a manner that the period for which the first switching circuit is on is made longer as compared with a case in which the difference is smaller than the predetermined difference.

8. The fixing device according to claim 3, wherein the total combined time during which the first and second switching circuits stay on per cycle is always the same.

9. A cyclical method for heating a fixing device wherein a predetermined output is supplied to each of a first coil and a second coil for heating a toner on a medium passing between a press member and a heating member, the method comprising the steps of:

detecting the temperature of the heating member heated by the first coil using a first temperature detector provided in the first coil;

detecting the temperature of the heating member heated by the second coil using a second temperature detector provided in the second coil;

determining a difference between the temperatures detected by the first and second detectors; and either:

setting the period for which the predetermined output is supplied to the first coil to a first time period, if the difference is greater than a predetermined difference; or setting the period for which the predetermined output is supplied to the first coil to a second time period, if the difference is less than or equal to the predetermined difference, wherein the first time period is longer than the second time period.

10. The method according to claim 9, wherein the combined time during which the predetermined output is supplied to the first and second coils is always the same per cycle.

11. The method according to claim 10, wherein the cyclical duration of the steps of detecting the temperature of the heating member heated by the first and second coils using a first and second temperature detectors, respectively, differs according to whether the fixing device is in warm-up state, is forming an image, or is in a standby state.

12. A cyclical method for heating a fixing device wherein a predetermined output is supplied to each of a first coil and a second coil for heating a toner on a medium passing between a press member and a heating member, the method comprising the steps of:

detecting the temperature of the heating member heated by the first coil using a first temperature detector provided in the first coil;

detecting the temperature of the heating member heated by the second coil using a second temperature detector provided in the second coil;

determining a difference between the temperatures detected by the first and second detectors; and either:

setting the period for which the predetermined output is supplied to the second coil to a first time period, if the difference is greater than a predetermined difference; or setting the period for which the predetermined output is supplied to the second coil to a second time period, if the difference is less than or equal to the predetermined difference, wherein the first time period is longer than the second time period.

13. The method according to claim 12, wherein the combined time during which the predetermined output is supplied to the first and second coils is always the same per cycle.

14. The method according to claim 13, wherein the cyclical duration of the steps of detecting the temperature of the heating member heated by the first and second coils using a first and second temperature detectors, respectively, differs according to whether the fixing device is in warm-up state, is forming an image, or is in a standby state.

* * * * *